US005911809A

United States Patent [19]

Cordy

[11] Patent Number: 5,911,809

[45] Date of Patent: Jun. 15, 1999

[54] COBALT-TIN ALLOY COATING ON ALUMINUM BY CHEMICAL CONVERSION

[75] Inventor: Carl Edward Cordy, Greenfield, Ind.

[73] Assignee: Ford Motor Company, Dearborn, Mich.

[21] Appl. No.: 09/050,215

[22] Filed: Mar. 30, 1998

[51] Int. Cl.[6] ..... F01B 3/00

[52] U.S. Cl. ..... 92/12.2; 92/57; 92/71; 417/269

[58] Field of Search ..... 92/12.2, 57, 71; 417/269

[56] References Cited

U.S. PATENT DOCUMENTS

| | | | |
|---|---|---|---|
| 4,568,252 | 2/1986 | Hattori et al. | 417/269 |
| 5,056,417 | 10/1991 | Kato et al. . | |
| 5,116,692 | 5/1992 | Mori et al. . | |
| 5,415,077 | 5/1995 | Ono | 92/71 |
| 5,468,130 | 11/1995 | Yamada et al. | 418/55.2 |
| 5,630,355 | 5/1997 | Ikeda et al. | 417/269 X |
| 5,655,432 | 8/1997 | Wilkosz et al. . | |
| 5,712,049 | 1/1998 | Huhn et al. | 428/626 |

*Primary Examiner*—Hoang Nguyen
*Attorney, Agent, or Firm*—Lorraine S. Melotik

[57] ABSTRACT

A swash plate type compressor having a cylinder block with cylinder bores disposed parallel to the axis of the cylinder block. A rotary shaft rotatably mounted within the cylinder block carries an aluminum swash plate. The swash plate is fixed in the rotary shaft and has two facial surfaces and an end surface. The swash plate has a coating preferably between 0.8 to 2.5 microns, of a tin/cobalt coating of at least 0.2 wt% cobalt and the balance being tin. A piston reciprocally fitted within the cylinder bore contains shoes which slideably intervene between the piston and the swash plate facial surfaces and reciprocate the piston and the swash plate facial surfaces and reciprocate the pistons by rotation of the swash plate. The coating on the swash plate permits the use of low silicon alloy aluminum without the need of metal plating or high finish polishing.

12 Claims, 2 Drawing Sheets

COBALT-TIN ALLOY COATING ON ALUMINUM BY CHEMICAL CONVERSION

BACKGROUND OF THE INVENTION

1. Field of the Invention

The present invention relates to a swash plate type compressor for compressing a refrigerant gas, by rotating a swash plate. More particularly, the present invention relates to an improvement to swash plate compressors by applying a tin and cobalt surface coating on the swash plate facial surfaces to reduce the frictional wear on the components. The swash plate body is produced from aluminum or aluminum alloy.

2. Disclosure Information

Conventionally, a swash plate type compressor is used in systems such as an air conditioning system of an automobile. According to a known swash plate type compressor, the transmission of motive power is carried out, as a swash plate and a piston reciprocate, thereby suctioning, compressing and discharging the gas. The swash plate is usually composed of aluminum or aluminum alloy and shoes, which make slideable contact with the swash plate when it rotates, are composed of iron or light weight ceramics such as alumina. The metal on metal contact at the shoe and swash plate interface requires special precautions to be taken in order to prevent undue wear and possible seizure of the shoe with the swash plate.

In a conventional swash plate compressor, the following problems are likely to occur. 1) The amount of oil contained in the refrigerant gas is decreased if the refrigerant leaks out of the swash plate type compressor. When the swash plate type compressor is operated under this state, lubrication at the sliding surface of the swash plate is decreased. In an extreme case, seizure of the shoe at the sliding surface of the swash plate occurs due to the generation of high temperature friction heat. 2) In the case where the compression of the liquid refrigerant takes place, the lubrication at the sliding surface of the swash plate is decreased. As a result, seizure of the shoe with the surface of the swash plate may occur.

Several methods have been developed to improve the lubrication at the shoe/swash plate interface and to lessen the wear of compressor swash plates. Conventional swash plates are treated with a tin coating to improve surface wear.

U.S. Pat. No. 5,655,432 treated the swash plate with a cross-linked polyfluoro elastomer bonded directly to the aluminum, a lubricious additive and a load bearing additive. The material is applied as a viscous fluid and is masked part in order to coat the component only at certain areas. The coating is also applied in a range of 13–50 microns and since the maximum allowed variation is only 10 microns the parts require machining after coating. The coating process itself adds to manufacturing complexity, and makes it more difficult to hold manufacturing tolerances than with a conventional tin conversion coating.

U.S. Pat. No. 5,056,417 treated the swash plate body with a surface coating layer made of tin and at least one metal selected from the group consisting of copper, nickel, zinc, lead and indium. While any of these five materials are alloyed with tin to improve its wear resistance, none of them are described as also acting to bind the coating to the swashplate. The current invention discloses a tin/cobalt coating with improved wear resistance and also excellent adhesion to the swashplate, in order to retain the high-lubricity of tin on the aluminum swashplate. Thus, in the current invention, the added cobalt provides a tin/cobalt surface coating with improved adhesion over a conventional adherent coating tin conversion coating, which improves the wear resistance of the aluminum swash plate.

SUMMARY OF THE INVENTION

For obviating the foregoing problems, associated with piston/swash plate interface is to provide a novel swash plate type compressor with improved seizure resistance.

A swash plate compressor having a cylinder block that has a cylinder bore disposed parallel to the axis of said cylinder block. A rotary shaft rotatably mounted within said cylinder block and a piston reciprocally fitted in the cylinder bore. The shoes slideably intervene between the piston and the swash plate. The swash plate comprises a matrix composed of aluminum or aluminum alloy and on at least a part of the swash plate surface a coating layer comprising at least 0.2 wt. % cobalt and the balance being tin. The coated part of the surface of the swash plate is that which in slideable contact with the shoes during compressor operation.

DETAILED DESCRIPTION OF THE PREFERRED EMBODIMENTS

Figure 1:
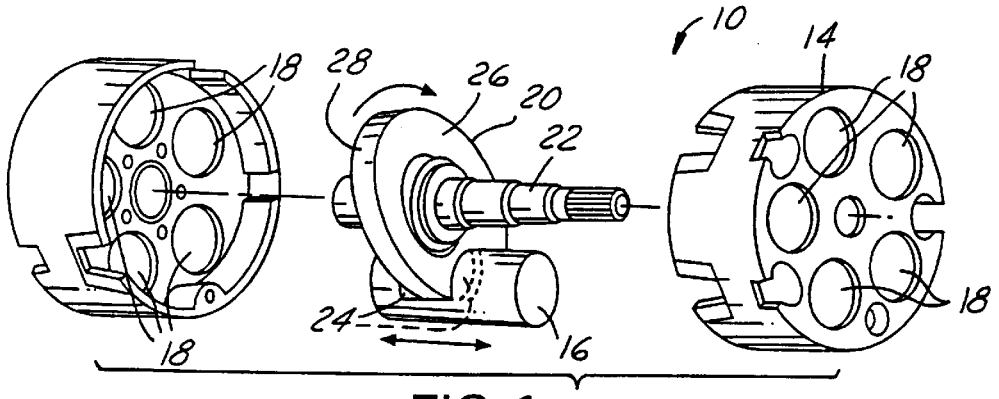
FIG. 1 is an exploded view of a swash plate compressor according to an embodiment of the present invention.

Illustrated in FIG. 1 is a perspective and exploded view of an automotive swash plate type compressor 10 for propelling refrigerant gas through a cooling circuit. The compressor 10 comprises a two-piece cylinder block 12, 14 which is provided with a plurality of reciprocating pistons 16. For clarity, FIG. 1 depicts only one of such reciprocating piston 16. In practice, each piston 16 reciprocates within cylinder bore 18.

Each piston 16 is in communication with the swash plate 20 which is fixably mounted on an axially extending rotateable shaft 22. The reciprocating motion of each piston 16 within its associated cylinder bore successively siphons, compresses, and discharges refrigerant gas. A pair of pivoting shoes 24 are positioned between each piston 16 and swash plate 20. The shoe 24 transfers the rotational motion of the swash plate 20 to the linear motion of the piston 16. The swash plate 20 has two facial surfaces 26 (only one shown for clarity) which contact the shoe 24.

Rotation of the shaft 22 causes the swash plate 20 to rotate between the cylinder blocks 12, and 14. The facial surfaces 26 contact the shoes 24 and are subjected to a shear-type frictional contact with shoe 24. An end surface 28 may contact the piston 16 if the piston 16 is slightly skewed or bent. End surface 28 and the facial surfaces 26 are coated to prevent wear from the contact with piston 16 and shoes 24. The surface coating 30 should also have a low coefficient of friction to increase the efficiency of the compressor.

The shape of swash plate 20 according to the present invention may be the same as those of the conventional swash plates. The material composing the matrix of swash plate body 20 should be aluminum or aluminum alloy. The aluminum alloy can be, for example, aluminum-high-silicon type alloy, aluminum-silicon magnesium type alloy, aluminum-silicon-copper-magnesium type alloy and, aluminum alloys containing no silicon.

Swash plate 20 is usually made from an aluminum or aluminum alloy material to make it light-weight and strong. Aluminum and aluminum alloys containing hypereutectic silicon, that is more silicon than is required to form a eutectic crystalline structure, are often used.

While the surface coating 30 of the present invention may be used with hypereutectic aluminum, it is primarily intended for use on non-hypereutectic aluminum and aluminum alloys having less than 12.5% by weight of silicon.

Hard grains, as used herein means grains having average particle diameters of 20 through 100 micrometer and a hardness greater than 300 on the Vickers hardness scale or, more preferably, having a hardness greater than 600 on the Vickers hardness scale, such as a primary crystal silicon. For example, aluminum-high-silicon type alloy can be considered as one of materials suitable materials for swash plate body 20. Because alsil alloy contains about 13% to 30% by weight of silicon meaning that alsil alloy contains more silicon than is required to form a eutectic crystal structure, alsil alloy has primary crystal silicon dispersed in the matrix structure. Also alsil has superior characteristics and could withstand very severe sliding operations at the swash plate.

Other materials having the hard grains and possibly applicable to swash plate body 20 are the intermetallic compounds of: aluminum-manganese; aluminum-silicon-manganese; aluminum-iron-manganese; aluminum-chromium and the like.

Conventionally, swash plate body 20 is made of aluminum or aluminum alloy directly contacts shoes 24. However, according to the present invention, during operation with surface coating layer 30, on swash plate body 20 contacts shoes 24 so that the frictional resistance with the shoes is greatly reduced. While it is only necessary to coat facial surface 26 having contact with shoes 24, for ease of manufacture the entire swash plate body 20 is coated.

According to the present invention, the swash plate body 20 has a surface coating layer 30. The surface coating layer 30 is formed on the surface of swash plate body 20 at least on the part of the surface having slidable contact with shoes 24. The surface coating layer 30 may, however, be formed over the whole surface of the swash plate body 20. The surface coating layer 30 acts to reduce frictional resistance with shoes 24 and prevents the occurrence of seizure at the sliding facial surface 26 of the swash plate 20.

The present invention surface coating layer 30 is composed primarily of tin, modified with cobalt. If surface coating layer 30 is composed only of tin the coefficient of friction will be lowered but at the same time, the surface coating layer becomes rather soft due to the characteristics of tin and, as a result, surface coating layer 30 will be susceptive to abrasion. In particular, by weight percent based on the total weight of the tin/cobalt surface coating 30 comprises 0.2–2.1 wt. % cobalt and the balance being tin, more preferably being 98.9 to 99.7 wt. % tin and 0.3 to 1.1 wt. % cobalt and most preferably 0.5 to 0.9 wt. % cobalt and the balance being tin.

It is found by the inventors of the present invention that the coexistence of tin and cobalt in the matrix structure of surface coating layer 30 provides a low coefficient of friction as well as improved hardness, so that high abrasion resistance is obtained. In addition, the adhesion of the coating to the swashplate 20 is improved by the addition of cobalt.

Surface coating 30 maybe applied to the swash plate 20 by means of a conversion coating. An aqueous tin bath is prepared according to convention and then cobalt chloride is dissolved in the bath and the aqueous solution is heated to a temperature above 120° F. The concentration of cobalt in the bath is that necessary to provide a coating on the swash plate of 0.2–2.1 wt. % cobalt with the balance being tin. Preferably the bath is in between 120° F. and 150° F. To provide that amount of cobalt/tin on swash plate 20, the bath generally comprises 0.003 to 0.03 wt. % cobalt chloride and 6–7.2 wt. % potassium stannate. More preferably, maintaining the same amount of potassium stannate, 0.005–0.015 wt. % cobalt chloride and most preferably 0.007–0.013 wt. % cobalt chloride. Additionally the bath comprises conventional materials like chelates and pH buffers.

Preferably the source of the cobalt ion is cobalt chloride, compounds such as cobalt nitrate do not demonstrate the same results.

Before applying surface coating 30, the swash plate 20 is exposed to a cleaning solution which removes surface oils and prepares the part for the coating application. Cleaning methods typically include solvent, acid or alkaline washings. The parts are then exposed to the solution for 5–6 minutes to coat.

The thickness of the surface coating 30 is preferably from 0.8 to 2.5 microns. Applicants found that if the surface coating layer 30 has a thickness of less than 0.8 microns, the coefficient of friction will not be sufficiently lowered. On the other hand, if the surface coating layer 30 has a thickness of more than 2.5 micrometers, the surface coating layer 30 will be susceptive to problems concerning its strength such as to resist peeling-off.

According to the present invention, the coefficient of friction between swash plate 20 and shoe 24 is small so that the smooth sliding of shoe 24 on the swash plate 20 is ensured. The surface coating layer 30 is superior in strength thereby reducing the amount of abrasion which occurs thereon. Still further, seizure of the shoe 24 to the surface of swash plate 20 is prevented even when a liquid refrigerant is compressed or the compressor is operated under unfavorable circumstances such as insufficient lubrication of the sliding parts caused by leaks of refrigerant gas to the outside of the compressor.

Consequently, by the effects described above, the swash plate compressor according to the present invention can satisfactory withstand very severe use and achieve long service life.

Experimental Results

Example 1: According to the swash plate type compressor as shown in FIG. 1, the swash plate 20 is composed of a swash plate body 20 made of an aluminum alloy containing 10–12.5% by weight of silicon, and the surface coating layer 30 (number will have to be added to the figure) formed on the whole surface of the swash plate body 20. The surface coating layer 30 consists of tin and cobalt as described below.

The surface coating layer 30 was formed by the following process:

The swash plate 20 was cleaned with alkaline cleaner at 140° F. for 5 minutes. The swash plate body 20 is immersed for 5 minutes into a aqueous bath solution which contains 6.6 wt. % potassium stannate and 0.007 wt. % cobalt chloride by weight, and which was kept at 130°–147° F. It was then taken out from the Sn/Co bath and water washed. As a result, a surface coating layer 30 consisting of tin and cobalt was formed over the whole surface of the swash plate body 20. The resultant surface coating layer 30 had a thickness of 1.0 micrometers and was composed of 99.5 wt. % tin, and 0.5 wt. % cobalt by weight.

Example 2: The swash plate body 20 as in Example 1, wherein the surface coating layer 30 was formed by the following process:

The swash plate 20 was cleaned with alkaline cleaner at 140° F. for 5 minutes. The swash plate body 20 is immersed for 5 minutes into a aqueous bath solution which contains 6.6 wt. % potassium stannate and 0.005 wt. % cobalt chloride by weight, and which was kept at 130°–147° F. It was then taken out from the Sn/Co bath and water washed. As a result, a surface coating layer 30 consisting of tin and cobalt was formed over the whole surface of the swash plate body 20. The resultant surface coating layer 30 had a thickness of 1.0 micrometers and was composed of 0.36 wt. % cobalt and the balance being tin.

Example 3 (a comparative example): The swash plate body as in Example 1 and 2 was coated with a Sn coating composition, not according to the present invention as follows:

The swash plate body 20 is immersed for 5 minutes into a aqueous solution which contains 6.6 wt. % potassium stannate, and which was kept at 130°–147° F. It was coated, taken out from the solution and water washed. As a result, a surface coating layer 30 having a thickness of 1.0 micrometers was composed of 100 wt. % tin was formed over the whole surface of the swash plate body 20.

Figure 2A:
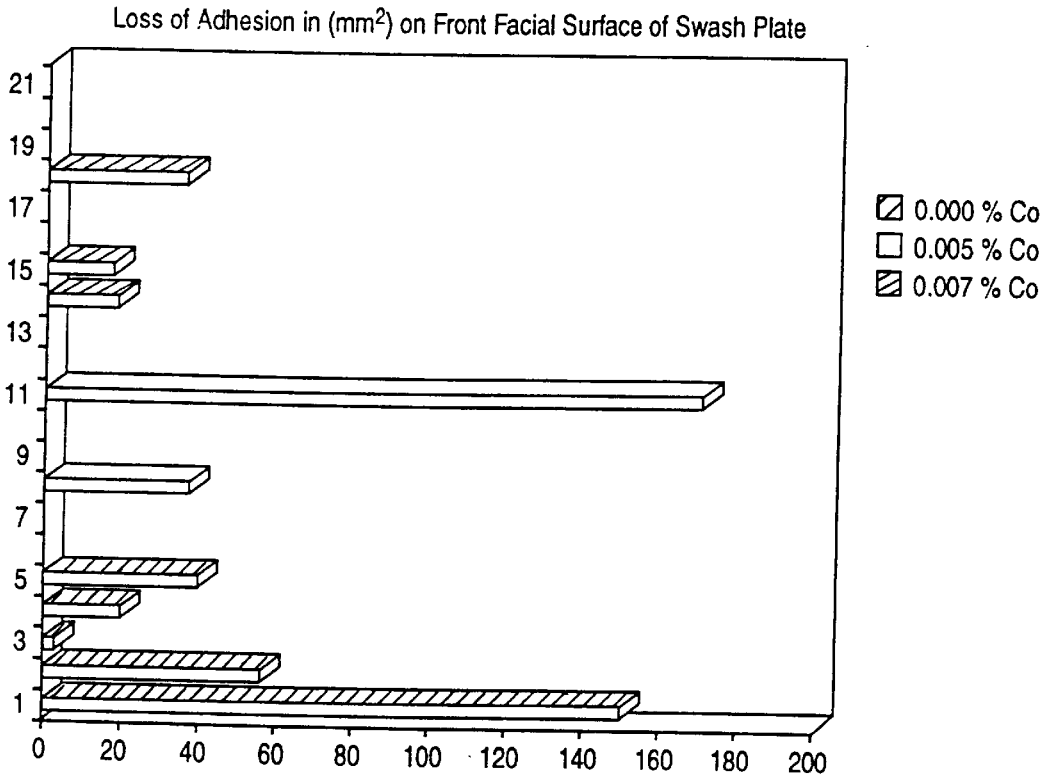
FIG. 2*a* (front facial surface) is a chart of 2 hour compressor adhesion performance test performed on an embodiment of the present invention and a conventional tin swash-plate.
Figure 2B:
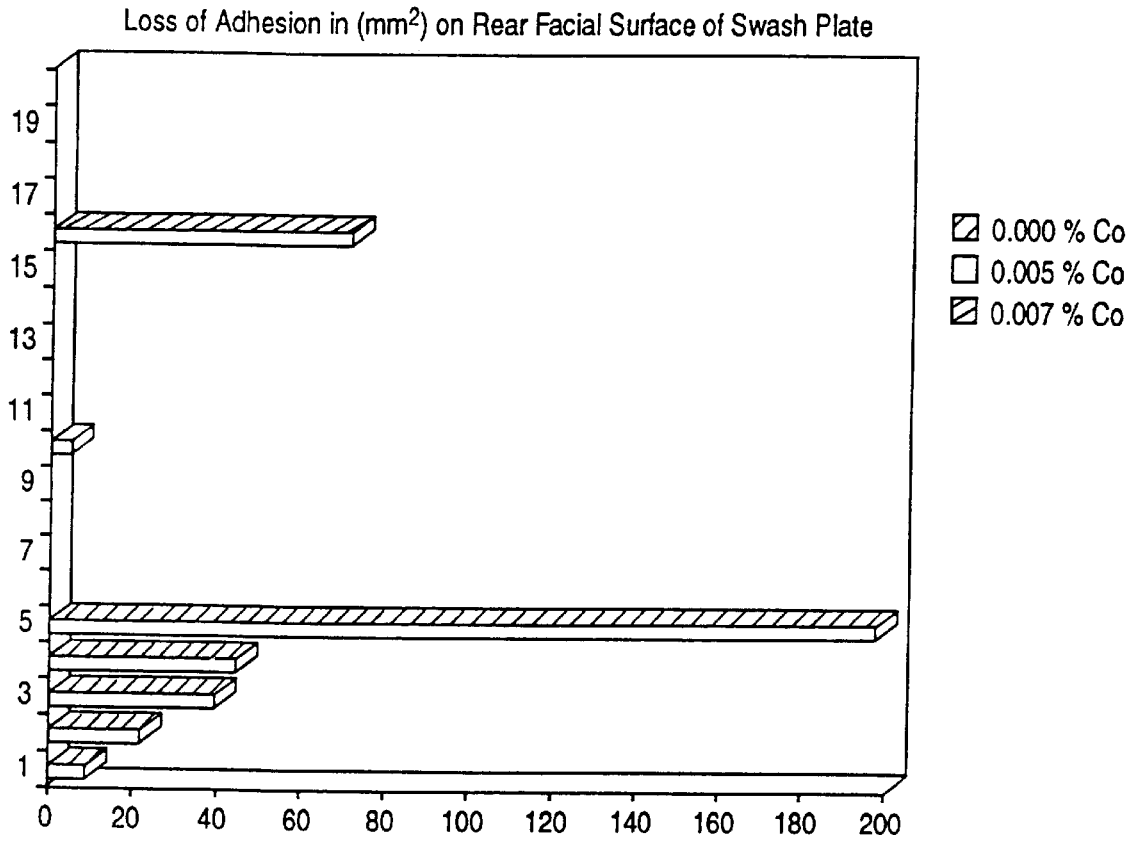
FIG. 2*b* (rear facial surface) is a chart of 2 hour compressor adhesion performance test performed on an embodiment of the present invention and a conventional tin swash-plate.

FIG. 2*a* and 2*b* illustrates the comparison of the two hour calorimeter test administered to three different coatings prepared above. The calorimeter test measures accelerated wear and loss of adhesion of a typical tin coating. Test samples are subject to the same conditions and then the wear of the coating is compared. The assembled compressor is subjected to both high and low speed usage. A test compressor pump was run for 1 hour at point 19, which stimulates low speed usage, and 1 hour at point 26 conditions, which stimulates high speed usage. At point 19, and 26 the compressor is subjected to 1000 and 3000 RPMs respectively. The data comparing the three coatings prepared in Examples 1–3 is compiled in Table 1. The wear of both facial surfaces 26 of the swash plate body 20 was compared.

| Wt. % Co | Loss of Adhesion | |
|---|---|---|
| in solution | Front Surface (mm) | Rear Surface (mm) |
| 0 | 150 | 10.4 |
| | 56.8 | 23.76 |
| | 4.15 | 39.93 |
| | 20.46 | 43.8 |
| | 40.2 | 194.94 |
| 0.005 | 0 | 0 |
| | 0 | 0 |
| | 38 | 0 |
| | 0 | 0 |
| | 0 | 6.3 |
| | 170.4 | 0 |
| 0.007 | 0 | 0 |
| | 0 | 0 |
| | 18 | 0 |
| | 16.8 | 0 |
| | 0 | 70 |
| | 0 | 0 |
| | 36 | 0 |
| | 0 | 0 |
| | 0 | 0 |
| | 0 | 0 |

As indicated in FIG. 2*a*, 2*b* and Table 1, the adhesion measured for swash plates 20 having the surface coating layer 30 in accordance with the embodiments of the present invention were much higher than that for the conventional type coating described in comparative Example 3. Also, a comparison between different levels of cobalt of the present invention, shows that the addition of higher levels of cobalt in the composition of the surface coating layer is effective in improving the adhesion and wear resistance of the swash plate 20. Thus, surface coating layer 30 of the comparative example 3, containing only tin, is more susceptive to rapid abrasion than a coating of tin and cobalt according to the present invention.

As is apparent from the test results shown in FIG. 2*a* and 2*b*, according to the present invention, the occurrence of loss of adhesion of the coating is greatly reduced due to the effect of the surface coating layer 30 although the swash plate type compressor is operated under severe conditions.

Swash plates 20 coated with the tin/cobalt coating do not exhibit the poor adhesion caused by poor wear resistance of pure tin coating because of the added cobalt.

Further Experimental Results

A standard tape adhesion test was administered on the samples prepared in examples 1–3. The test measures the amount of coating that can be removed when placed under stress. 3M 610 cellophane tape was applied to the coated swashplates in 2–3 mm strips. The tape was rubbed with a rubber eraser to ensure the adhesion of the tape and then the tape was removed in one quick motion in which a 90 degree angle was kept between the tape and the surface of swash plate 20. The coating with no cobalt, (all tin) showed poorest adhesion. Adhesion improved correspondingly with increasing amounts of cobalt in the coatings, i.e., the cobalt/tin coating with 0.005 wt. % Co had improved adhesion over the 0.005 wt. % cobalt/tin coating.

Also, according to the present invention, even in the state where the surface coating layer 30 of the swash plate 20 is gradually reduced by abrasion, the primary crystal silicon dispersed on the surface of the swash plate body 20 was exposed and sticks on the swash plate surface 20. Since primary crystal silicon has a great hardness, the further abrasion of the surface coating layer 30 is prevented.

It will be obvious to those of skill in the art that various modifications variations may be made to the foregoing invention without departing from the spirit and scope of the claims that follow.

We claim:

1. A swash plate type compressor comprising:

a cylinder block having a cylinder bore disposed parallel to the axis of said cylinder block;

a rotary shaft rotatably mounted within said cylinder block;

a swash plate fixed to said rotary shaft for rotation with said rotary shaft within said cylinder block;

a piston reciprocally fitted in said cylinder bore; and shoes which slideably intervene between said piston and said swash plate wherein said swash plate comprises a matrix composed of aluminum or aluminum alloy and, on at least a part of the swash plate surface a coating layer comprising at least 0.2 wt. % cobalt and the balance being tin, said coated part of the surface of said swash plate is in slideable contact with said shoes.

2. The swash plate type compressor of claim 1, wherein said matrix of said swash plate contains hard grains having an average particle diameter of from 20 to 100 micrometers and a hardness greater that 300 on the Vickers hardness scale.

3. The swash plate type compressor of claim 2, wherein said matrix of said swash plate contains hard grains having the hardness greater than 600 on the Vickers hardness scale.

4. The swash plate compressor of claim 1, wherein said matrix of said swash plate comprises aluminum-high-silicon type alloy which includes 13% to 30% silicon by weight.

5. The swash plate compressor of claim 1, wherein said swash plate comprises an aluminum-silicon type alloy having 13% or less by weight of silicon.

6. The swash plate compressor of claim 2, wherein said swash plate comprises an aluminum-silicon type alloy having about 10–12.5% by weight of silicon.

7. The swash plate compressor of claim 1, wherein the thickness of said surface coating layer is from 0.8 to 2.5 microns.

8. The swash plate compressor of claim 1, wherein the thickness of said surface coating layer is from 1.1–1.8 microns.

9. The swash plate compressor of claim 1, wherein the coating comprises 0.2–2.1 wt. % cobalt.

10. The swash plate compressor of claim 1, wherein the coating comprises 0.3–1.1 wt. % cobalt.

11. A method of coating a swash plate for a swash plate type compressor comprising the steps of:

providing a swash plate from a low silicon aluminum alloy which includes less than 13% by weight of silicon, said swash plate having two surfaces and an end surface;

exposing said swash plate to an aqueous tin bath at 120–150° F., said bath comprising tin and cobalt in such amounts to provide a conversion coating of 0.5 to 0.9% cobalt and the balance being tin on said swash plate surface.

12. The method according to claim 12, wherein said cobalt in said bath is provided by cobalt chloride.

* * * * *